US008011152B2

(12) United States Patent
Thomassen

(10) Patent No.: US 8,011,152 B2
(45) Date of Patent: Sep. 6, 2011

(54) BLOCK SUITABLE FOR USE IN AN ARRANGEMENT OF INTERLOCKING BLOCKS

(75) Inventor: Marcel Thomassen, Charlemagne (CA)

(73) Assignee: Transpave Inc., Saint-Eustache, Quebec (CA)

( * ) Notice: Subject to any disclaimer, the term of this patent is extended or adjusted under 35 U.S.C. 154(b) by 391 days.

(21) Appl. No.: 12/282,620

(22) PCT Filed: Feb. 28, 2008

(86) PCT No.: PCT/CA2008/000387

§ 371 (c)(1),
(2), (4) Date: Sep. 11, 2008

(87) PCT Pub. No.: WO2009/062283

PCT Pub. Date: May 22, 2009

(65) Prior Publication Data

US 2010/0162648 A1 Jul. 1, 2010

Related U.S. Application Data

(60) Provisional application No. 60/987,459, filed on Nov. 13, 2007.

(51) Int. Cl.
*E04F 15/00* (2006.01)

(52) U.S. Cl. ..... 52/311.2; 52/604; 52/608; 52/612; 404/29; 404/41; 404/42; D25/113

(58) Field of Classification Search ..... 52/311.2, 52/574, 596–612; 404/29–31, 34, 41, 42; D25/102, 112–118, 158

See application file for complete search history.

(56) References Cited

U.S. PATENT DOCUMENTS 1,474,779 A * 11/1923 Zur Kammer ..... 52/311.2

(Continued)

FOREIGN PATENT DOCUMENTS

CA 2229625 2/1997

(Continued)

OTHER PUBLICATIONS

Westone, "Random Panels", http.//www.westones.com/html/random/random2.htm, May 11, 2008, 6 pages.

(Continued)

*Primary Examiner* — William Gilbert

(57) ABSTRACT

A block suitable for use in an arrangement of blocks that are interlocked. The block may comprise: a first side surface extending between a first edge and a second edge, the first side surface being irregular and having a first half and a second half that are congruent; a second side surface extending between the second edge and a third edge, the second side surface having a first half and a second half that are congruent; a third side surface extending between the first edge and a fourth edge, the third side surface being congruent with a first portion of the first side surface; a fourth side surface extending between the third edge and a fifth edge, the fourth side surface being congruent with a second portion of the first side surface such that the first portion and the second portion of the first side surface constitute the first side surface; and a fifth side surface extending between the fourth edge and the fifth edge, the fifth side surface having a first half and a second half that are congruent. The arrangement of blocks may be part of a paved surface, a wall or another structure, or may be used in various other applications.

30 Claims, 8 Drawing Sheets

U.S. PATENT DOCUMENTS

| | | | | | |
|---|---|---|---|---|---|
| 3,947,192 | A | | 3/1976 | Rosenberger | |
| 4,354,773 | A | * | 10/1982 | Noack | 404/41 |
| D397,802 | S | | 9/1998 | Terry | |
| D404,147 | S | | 1/1999 | Woolford | |
| 5,884,445 | A | | 3/1999 | Woolford | |
| D439,677 | S | | 3/2001 | Mattox | |
| D488,566 | S | | 4/2004 | Fleishman | |
| D522,667 | S | | 6/2006 | Castonguay et al. | |
| D537,501 | S | | 2/2007 | Riccobene | |
| D537,959 | S | | 3/2007 | Castonguay et al. | |
| D543,642 | S | | 5/2007 | Castonguay et al. | |
| D578,658 | S | | 10/2008 | Keys | |
| D578,659 | S | | 10/2008 | Keys | |
| D578,660 | S | | 10/2008 | Keys | |

FOREIGN PATENT DOCUMENTS

| | | |
|---|---|---|
| CA | 90963 | 11/2000 |
| CA | 2569998 | 5/2006 |
| CA | 2616200 | 4/2008 |
| WO | WO95/33889 | 12/1995 |
| WO | WO2006/045192 | 5/2006 |
| WO | PCT/CA2008/000387 | 8/2008 |

OTHER PUBLICATIONS

Hanover, "Halifax Flagstone", http://www.hanoverpavers.com/residential/html/halifax_irr.html, Feb. 6, 2008, 3 pages.

* cited by examiner

BLOCK SUITABLE FOR USE IN AN ARRANGEMENT OF INTERLOCKING BLOCKS

CROSS-REFERENCE TO RELATED APPLICATION

This application claims priority from U.S. Provisional Patent Application No. 60/987,459 filed on Nov. 13, 2007 by Marcel Thomassen et al. and hereby incorporated by reference herein.

FIELD OF THE INVENTION

The present invention relates to blocks that can be interlocked and that can be used in making structures such as paved surfaces, walls and other types of structures, or in various other applications.

BACKGROUND

Arrangements of interlocking blocks can be used for various purposes. For example, a paved surface can be made of a plurality of concrete blocks, such as pavers, paving tiles or other types of paving units, which are interlocked in a particular pattern.

Concrete blocks used in a paved surface typically have simple prismatic shapes, such as rectangular prisms. In cases where the concrete blocks have a natural stone appearance to give a natural and aesthetic look to the paved surface, their simple prismatic shapes, which lack randomness, tend to diminish the paved surface's natural look. While some paving blocks have been provided with slightly irregular shapes, their ability to appear randomly shaped is limited and they therefore still result in paved surfaces with a somewhat deficient natural feel. Also, these slightly irregularly shaped paving blocks typically need to be arranged in a relatively intricate pattern which complicates their installation.

Similar deficiencies may be encountered in other types of structures that can be made of interlocking blocks, such as walls, decorative surfaces, or structures used for various other purposes, as well as in various other applications that use arrangements of interlocking blocks.

Accordingly, there is a need for blocks that appear to have highly random shapes and that can be easily arranged for making structures, such as paved surfaces, walls or other types of structures, or for various other applications.

SUMMARY OF THE INVENTION

As embodied and broadly described herein, the invention provides a block suitable for use in an arrangement of blocks that are interlocked. The block comprises: a first side surface extending between a first edge and a second edge, the first side surface being irregular and having a first half and a second half that are congruent; a second side surface extending between the second edge and a third edge, the second side surface having a first half and a second half that are congruent; a third side surface extending between the first edge and a fourth edge, the third side surface being congruent with a first portion of the first side surface; a fourth side surface extending between the third edge and a fifth edge, the fourth side surface being congruent with a second portion of the first side surface such that the first portion and the second portion of the first side surface constitute the first side surface; and a fifth side surface extending between the fourth edge and the fifth edge, the fifth side surface having a first half and a second half that are congruent.

The invention also provides a block suitable for use in an arrangement of blocks that are interlocked. The block comprises a plurality of side surfaces configured such that the block has a shape formed of a plurality of contiguous instances of a basic shape. The basic shape comprises: a first side surface extending between a first edge and a second edge, the first side surface being irregular and having a first half and a second half that are congruent; a second side surface extending between the second edge and a third edge, the second side surface having a first half and a second half that are congruent; a third side surface extending between the first edge and a fourth edge, the third side surface being congruent with a first portion of the first side surface; a fourth side surface extending between the third edge and a fifth edge, the fourth side surface being congruent with a second portion of the first side surface such that the first portion and the second portion of the first side surface constitute the first side surface; and a fifth side surface extending between the fourth edge and the fifth edge, the fifth side surface having a first half and a second half that are congruent.

The invention also provides a set of blocks capable of interlocking with one another. Each block comprises a plurality of side surfaces configured such that the block has a shape formed of at least one instance of a basic shape. The basic shape comprises: a first side surface extending between a first edge and a second edge, the first side surface being irregular and having a first half and a second half that are congruent; a second side surface extending between the second edge and a third edge, the second side surface having a first half and a second half that are congruent; a third side surface extending between the first edge and a fourth edge, the third side surface being congruent with a first portion of the first side surface; a fourth side surface extending between the third edge and a fifth edge, the fourth side surface being congruent with a second portion of the first side surface such that the first portion and the second portion of the first side surface constitute the first side surface; and a fifth side surface extending between the fourth edge and the fifth edge, the fifth side surface having a first half and a second half that are congruent. The set of blocks comprises: a first block having a shape formed of a single instance of the basic shape; and a second block having a shape formed of a plurality of contiguous instances of the basic shape.

The invention also provides a block suitable for use in an arrangement of blocks that are interlocked. The block comprises: a first side surface extending between a first edge and a second edge, the first side surface being irregular and having a first half and a second half that are congruent; a second side surface extending between the second edge and a third edge, the second side surface having a first half and a second half that are congruent; a third side surface extending between the third edge and a fourth edge, the third side surface being congruent with the first side surface; a fourth side surface extending between the fourth edge and a fifth edge, the fourth side surface being congruent with the first side surface; a fifth side surface extending between the fifth edge and a sixth edge, the fifth side surface being congruent with the second side surface; and a sixth side surface extending between the first edge and the sixth edge, the sixth side surface being congruent with the first side surface.

The invention also provides a block suitable for use in an arrangement of blocks that are interlocked. The block comprises: a first side surface extending between a first edge and a second edge, the first side surface being irregular and having a first half and a second half that are congruent, the first side surface having a profile length; a second side surface extending between the second edge and a third edge, the second side surface having a first half and a second half that are congruent; a third side surface extending between the first edge and a fourth edge, the third side surface being congruent with a first portion of the first side surface, the third side surface having a profile length; a fourth side surface extending between the third edge and a fifth edge, the fourth side surface being congruent with a second portion of the first side surface, the fourth side surface having a profile length, the profile length of the first side surface corresponding to the profile length of the third side surface added to the profile length of the fourth side surface; and a fifth side surface extending between the fourth edge and the fifth edge, the fifth side surface having a first half and a second half that are congruent.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the present invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
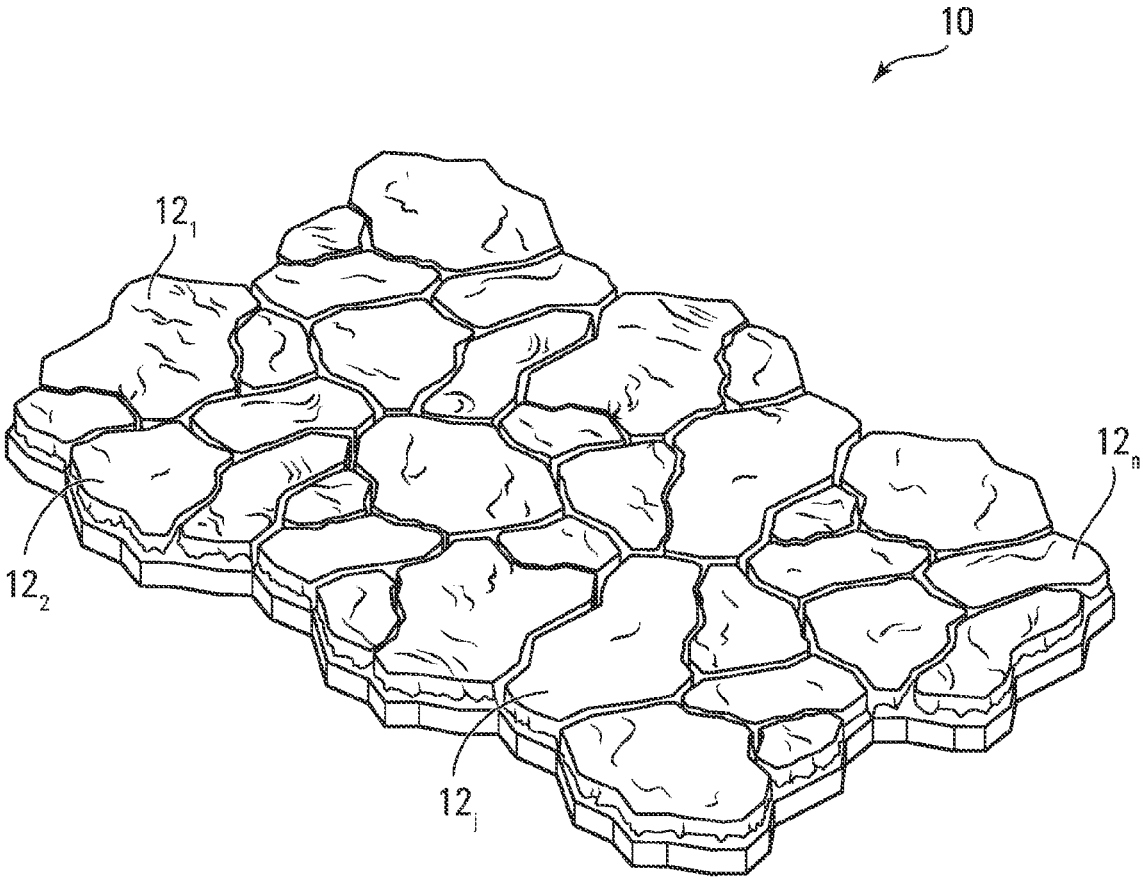
FIG. 1 shows a paved surface comprising a plurality of concrete blocks in accordance with an embodiment of the invention.

FIG. 1 shows a structure 10 comprising an arrangement of concrete blocks $\mathbf{12}_1 \ldots \mathbf{12}_N$ that are interlocked, in accordance with an embodiment of the present invention. In this embodiment, the structure 10 is a paved surface and the concrete blocks $\mathbf{12}_1 \ldots \mathbf{12}_N$ are pavers, paving tiles, or other types of paving units.

Figure 2:
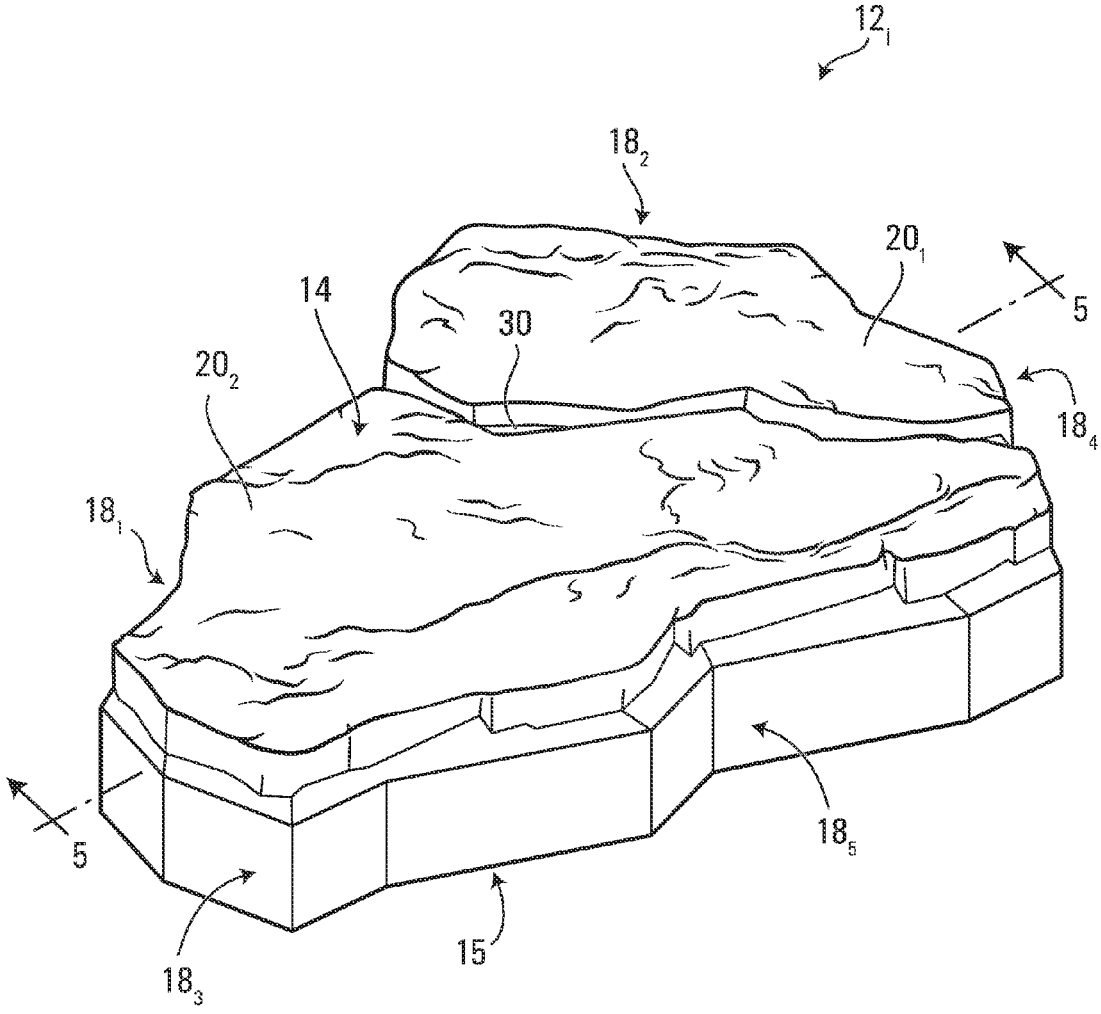
FIG. 2 shows a perspective view of a given concrete block of the concrete blocks shown in FIG. 1.

A given concrete block $\mathbf{12}_j$ of the concrete blocks $\mathbf{12}_1 \ldots \mathbf{12}_N$ ($1 \leqq j \leqq N$) will be described in further detail with additional reference to FIGS. 2 and 3, with this description similarly applying to other ones of the concrete blocks $\mathbf{12}_1 \ldots \mathbf{12}_N$.

In this embodiment, the concrete block $\mathbf{12}_j$ is a dry-cast concrete block, i.e., it is made of no-slump concrete. No-slump concrete (also known as zero-slump concrete) can be viewed as concrete with a slump of 6 mm or less. It will be appreciated that various types of no-slump concrete are possible and may be used. It will also be appreciated that other types of concrete (e.g., measurable-slump concrete) may be used in other embodiments.

The concrete block $\mathbf{12}_j$ comprises a front surface 14, a rear surface 15, and five (5) side surfaces located between the front surface 14 and the rear surface 15, namely a first side surface $\mathbf{18}_1$, a second side surface $\mathbf{18}_2$, a third side surface $\mathbf{18}_3$, a fourth side surface $\mathbf{18}_4$ and a fifth side surface $\mathbf{18}_5$. The front surface 14 is intended to be exposed when the concrete block $\mathbf{12}_j$ is placed in the paved surface 10.

The side surfaces $\mathbf{18}_1 \ldots \mathbf{18}_5$ are configured such that the concrete block $\mathbf{12}_j$ has an irregular shape that gives it a natural appearance. When placed in the paved surface 10, the concrete block and other ones of the concrete blocks $\mathbf{12}_1 \ldots \mathbf{12}_N$ provide a natural and aesthetic look to the paved surface 10, which appears to be made of several highly randomly shaped natural stones. Also, the side surfaces $\mathbf{18}_1 \ldots \mathbf{18}_5$ are configured such that the concrete blocks $\mathbf{12}_1 \ldots \mathbf{12}_N$ can be easily installed in courses in a running bond (also known as a "stretcher bond") or other linear bond.

In order to allow the concrete block $\mathbf{12}_j$ with its irregular shape to interlock with other ones of the concrete blocks $\mathbf{12}_1 \ldots \mathbf{12}_N$ and to allow these blocks to be installed in courses, the side surfaces $\mathbf{18}_1 \ldots \mathbf{18}_5$ are configured according to a set of rules which ensure that each of these side surfaces can register with a mating side surface of an adjacent one of the concrete blocks $\mathbf{12}_1 \ldots \mathbf{12}_N$, as further discussed below.

Figure 3:
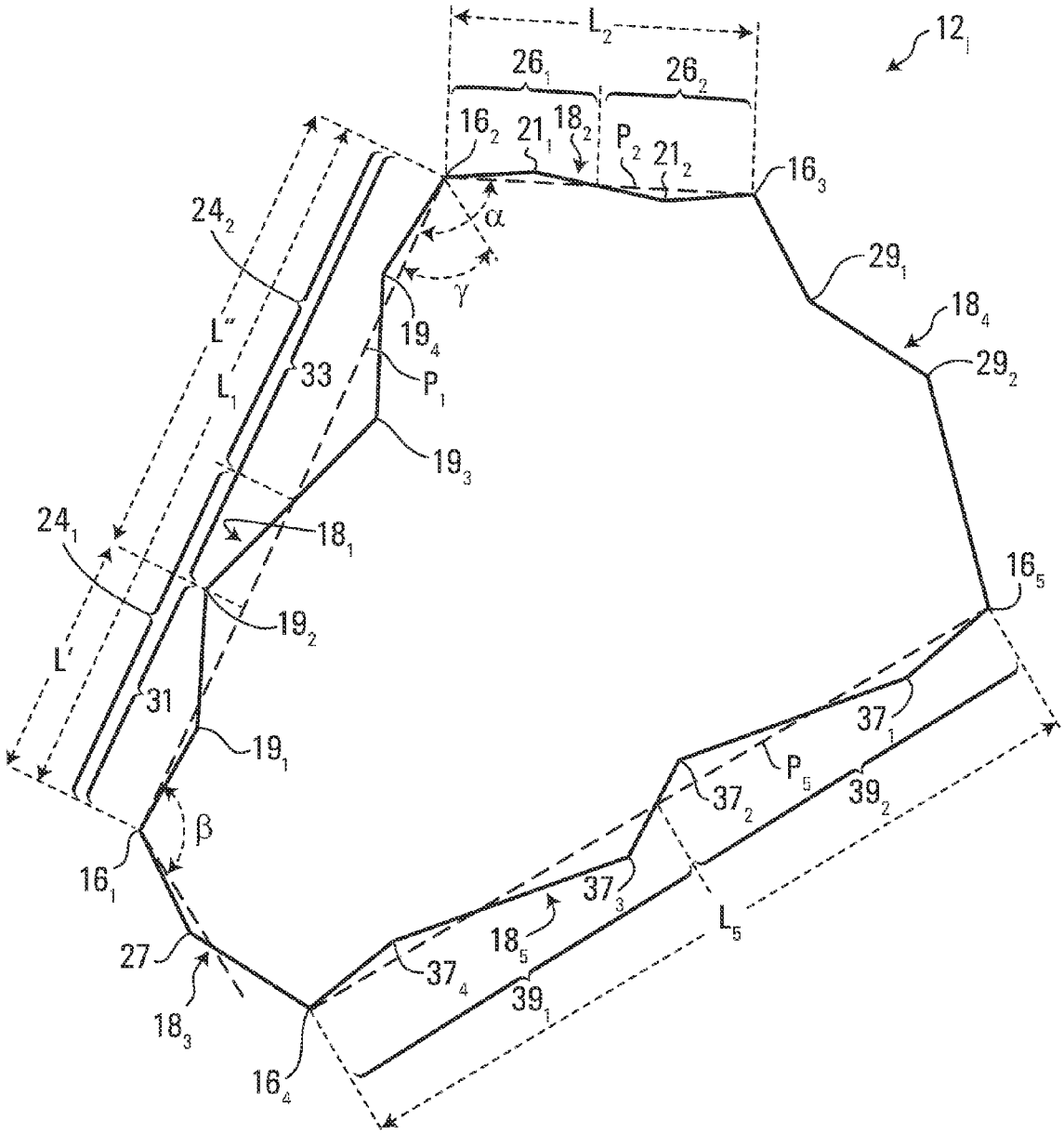
FIG. 3 shows an outline of side surfaces of the given concrete block shown in FIG. 2.

As best shown in FIG. 3, the first side surface $\mathbf{18}_1$, which extends between edges $\mathbf{16}_1$, $\mathbf{16}_2$, is irregular, i.e., it has an irregular profile that deviates from an imaginary plane $P_1$ extending between the edges $\mathbf{16}_1$, $\mathbf{16}_2$. More particularly, the first side surface $\mathbf{18}_1$ has irregularities $\mathbf{19}_1 \ldots \mathbf{19}_4$ that provide its irregular profile. In this embodiment, the irregularities $\mathbf{19}_1 \ldots \mathbf{19}_4$ are angled portions. In other embodiments, other forms of angled portions and/or other types of irregularities may be provided (e.g., curved portions).

In accordance with the aforementioned set of rules, the first side surface $\mathbf{18}_1$ has a first half $\mathbf{24}_1$ and a second half $\mathbf{24}_2$ that are congruent. More specifically, when viewing the first side surface $\mathbf{18}_1$ as a two-dimensional locus of points, the second half $\mathbf{24}_2$ of the first side surface $\mathbf{18}_1$ corresponds to a rotated version of the first half $\mathbf{24}_1$ of the first side surface $\mathbf{18}_1$, i.e., the second half $\mathbf{24}_2$ corresponds to the first half $\mathbf{24}_1$ rotated by 180°. With this congruence, the irregularity $\mathbf{19}_1$ is congruent with the irregularity $\mathbf{19}_4$ and the irregularity $\mathbf{19}_2$ is congruent with the irregularity $\mathbf{19}_3$.

The second side surface $\mathbf{18}_2$ extends between the edge $\mathbf{16}_2$ and an edge $\mathbf{16}_3$ and, in this case, is irregular, i.e., it has an irregular profile which deviates from an imaginary plane $P_2$ extending between the edges $\mathbf{16}_2$ and $\mathbf{16}_3$. More particularly, the second side suffice $\mathbf{18}_2$ has irregularities $\mathbf{21}_1$ and $\mathbf{21}_2$, in this case angled portions, which provide its irregular profile.

In accordance with the aforementioned set of rules, the second side surface $\mathbf{18}_2$ has a first half $\mathbf{26}_1$ and a second half $\mathbf{26}_2$ that are congruent. More particularly, when viewing the second side surface $\mathbf{18}_2$ as a two-dimensional locus of points, the second half $\mathbf{26}_2$ of the second side surface $\mathbf{18}_2$ corresponds to a rotated version of the first half $\mathbf{26}_1$ of the second side surface $\mathbf{18}_2$, i.e., the second half $\mathbf{26}_2$ corresponds to the first half $\mathbf{26}_1$ rotated by 180°. With this congruence, the irregularities $\mathbf{21}_1$ and $\mathbf{21}_2$ are congruent.

The first and second side surfaces $\mathbf{18}_1$, $\mathbf{18}_2$ have respective projected lengths $L_1$, $L_2$ measured along the imaginary planes $P_1$ and $P_2$, which define an angle $\alpha$ therebetween. The projected lengths $L_1$, $L_2$ as well as the angle $\alpha$ can be selected as desired.

The third side surface $18_3$ extends between the edge $16_1$ and an edge $16_4$. In accordance with the aforementioned set of rules, the third side surface $18_3$ is congruent with a portion 31 of the first side surface $18_1$. More specifically, when viewed as a two-dimensional locus of points, the third side surface $18_3$ corresponds to a rotated version of the portion 31 of the first side surface $18_1$, i.e., the third side surface $18_3$ corresponds to the portion 31 of the first side surface $18_1$ rotated by an angle β about the edge $16_1$. In this case, as the portion 31 of the first side surface $18_1$ includes the irregularity $19_1$, the third side surface $18_3$ has an irregularity 27 congruent with the irregularity $19_1$ and is thus irregular.

The portion 31 of the first side surface $18_1$ can be selected and rotated as desired to generate the third side surface $18_3$. More specifically, the portion 31 of the first side surface $18_1$ has a projected length L' measured along the imaginary plane $P_1$, and the projected length L' and the angle β can be selected as desired.

The fourth side surface $18_4$, which extends between the edge $16_3$ and an edge $16_5$, is opposite to the third side surface $18_3$. In accordance with the aforementioned set of rules, the fourth side surface $18_4$ is congruent with a portion 33 of the first side surface $18_1$ such that the portion 33 and the portion 31 of the first side surface $18_1$ together constitute the first side surface $18_1$. In other words, the first side surface $18_1$ is made of both portions 31, 33.

When viewed as a two-dimensional locus of points, the fourth side surface $18_4$ corresponds to a rotated and translated version of the portion 33 of the first side surface $18_1$, i.e., the fourth side surface $18_4$ corresponds to the portion 33 of the first side surface $18_1$ rotated by an angle γ about the edge $16_2$ and translated to locate its end at the edge $16_3$. In this case, as the portion 33 of the first side surface $18_1$ includes the irregularities $19_3$, $19_4$, the fourth side surface $18_4$ has irregularities $29_1$, $29_2$ respectively congruent with the irregularities $19_4$, $19_3$ and is thus irregular.

As it is complementary to the portion 31 of the first side surface $18_1$, the portion 33 of the first side surface $18_1$ has a projected length L" measured along the imaginary plane $P_1$ such that the projected length L" added to the projected length L' of the portion 31 of the first side surface $18_1$ corresponds to the projected length $L_1$ of the first side surface $18_1$ (i.e., $L_1$=L'+L"). Also, the angles β and γ are supplementary angles (i.e., β+γ=180°).

While the projected length $L_1$ corresponds to the projected length L' added to the projected length L", it is also understood that the length of the first side surface $18_1$ equals the length of the third side surface $18_3$ added to the length of the fourth side surface $18_4$, when such lengths are measured along the profile of the respective side surfaces $18_1$, $18_3$, $18_4$ (e.g., with a ruler or a measuring tape). Hence, in accordance with the aforementioned set of rules, the first side surface $18_1$ has a profile length (i.e., an actual length) that corresponds to the profile length of the third side surface $18_3$ added to the profile length of the fourth side surface $18_4$.

The fifth side surface $18_5$ extends between the edges $16_4$, $16_5$ and, in this case, is irregular, i.e., it has an irregular profile which deviates from an imaginary plane $P_5$ extending between the edges $16_4$, $16_5$. More particularly, the fifth side surface $18_5$ has irregularities $37_1$ . . . $37_4$, in this case angled portions, which provide its irregular profile.

In accordance with the aforementioned set of rules, the fifth side surface $18_5$ has a first half $39_1$ and a second half $39_2$ that are congruent. More particularly, when viewing the fifth side surface $18_5$ as a two-dimensional locus of points, the second half $39_2$ of the fifth side surface $18_5$ corresponds to a rotated version of the first half $39_1$ of the fifth side surface $18_5$, i.e., the second half $39_2$ corresponds to the first half $39_1$ rotated by 180°. With this congruence, the irregularity $37_1$ is congruent with the irregularity $37_4$ and the irregularity $37_2$ is congruent with the irregularity $37_3$.

It will thus be appreciated that, with its side surfaces $18_1$ . . . $18_5$ configured as described above, the concrete block $12_j$ has an irregular shape that gives it a natural appearance and that allows it to be interlocked with other ones of the concrete blocks $12_1$ . . . $12_N$ when placed in the paved surface 10, thereby resulting in the paved surface 10 appearing to be made of several randomly shaped natural stones. In particular, with its five (5) side surfaces $18_1$ . . . $18_5$ which, in this embodiment, are shaped differently from one another (i.e., have five (5) mutually different profiles), each of the concrete blocks $12_1$ . . . $12_N$ appears to have a highly random shape which, when patterned with other ones of the concrete blocks $12_1$ . . . $12_N$, contributes to imparting to the paved surface 10 a highly natural and random look. In addition, with their side surfaces $18_1$ . . . $18_5$ configured as described above, the concrete blocks $12_1$ . . . $12_N$ can be easily installed in courses in a running bond or other linear bond.

In this embodiment, in order to further enhance a natural appearance of the paved surface 10, the front surface 14 of the concrete block $12_j$ comprises two (2) portions $20_1$, $20_2$ that represent two (2) natural stones. Each of the portions $20_1$, $20_2$ of the front surface 14 has a texture with a natural stone appearance, i.e., an aged, worn, or weathered appearance that resembles natural stone. More particularly, in this embodiment, this texture is a cast texture that is realized during casting of the concrete block $12_j$ and that may be based on a natural stone's surface which has been used to produce a mold for casting the concrete block $12_j$. For ease of reference, the portions $20_1$, $20_2$ of the front surface 14 and their cast texture with a natural stone appearance will hereinafter be referred to as the "natural-stone-like surface portions" $20_1$, $20_2$.

The natural-stone-like surface portions $20_1$, $20_2$ are separated from each other by a depression 30 of the front surface 14 that can serve as a false joint. When the concrete block $12_j$ is placed in the paved surface 10, the natural-stone-like surface portions $20_1$, $20_2$ result in an area of the paved surface 10 being perceivable as including plural (in this case, two (2)) natural stones of different sizes and configurations.

Although the front surface 14 comprises a plurality of natural-stone-like surface portions (in this case, two (2)), it is to be understood that, in other embodiments, any number of natural-stone-like surface portions may be provided. For example, in FIG. 1, some of the concrete blocks $12_1$ . . . $12_N$ are provided with three (3) natural-stone-like surface portions. As another example, in a particular case, the front surface 14 may comprise only one natural-stone-like surface portion, which may be an entirety of the front surface 14 (i.e., all of that surface) or a limited portion of the front surface 14 (i.e., less than all of that surface). It is also to be understood that, in some embodiments, the front surface 14 may not comprise any natural-stone-like surface portion.

Figure 4:
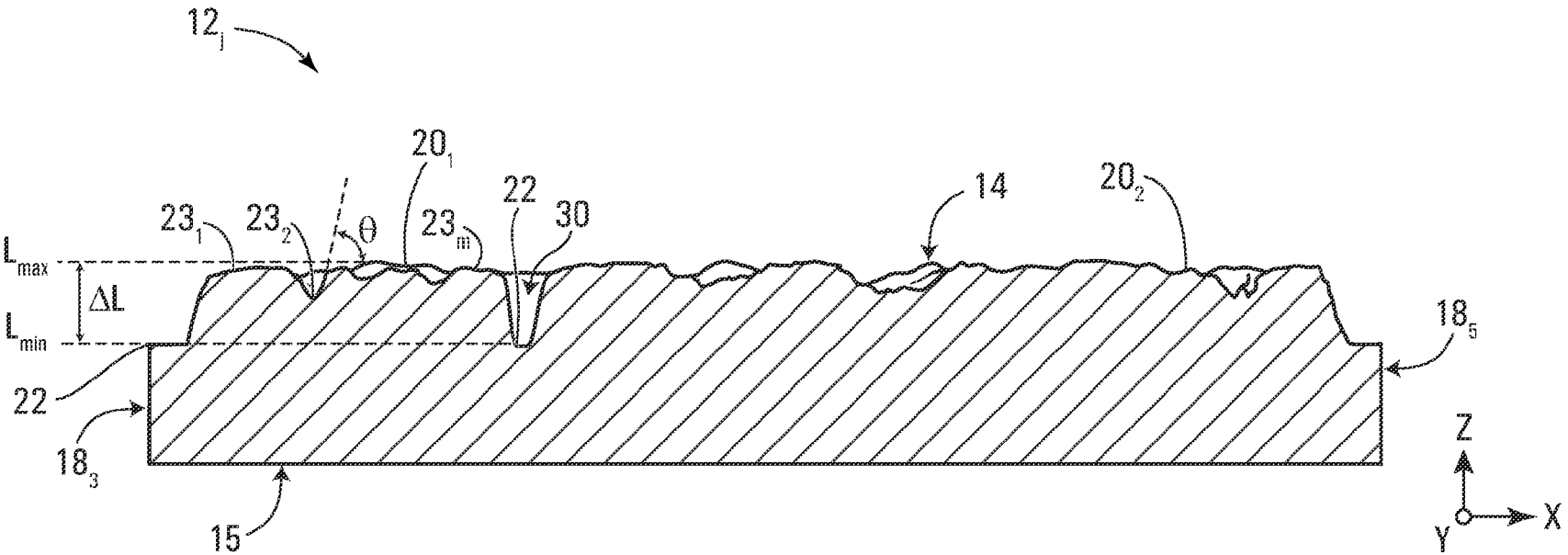
FIG. 4 shows a cross-sectional view of the given concrete block shown in FIG. 2.

With additional reference to FIG. 4, a given natural-stone-like surface portion $20_k$ of the natural-stone-like surface portions $20_1$, $20_2$ ($1 \leqq k \leqq 2$) will be described in further detail, with this description similarly applying to the other one of the natural-stone-like surface portions $20_1$, $20_2$.

The natural-stone-like surface portion $20_k$ has a visually discernible boundary 22. In cases where the natural-stone-like surface portion $20_k$ is contiguous to a chamfered, rounded, or otherwise unnatural-looking edge portion of the concrete block $12_j$, the boundary 22 of that natural-stone-like surface portion would be considered to be configured such that the chamfered, rounded or otherwise unnatural-looking edge portion is not part of that natural-stone-like surface portion.

The natural-stone-like surface portion $\mathbf{20}_k$ includes a pattern of cast relief elements $\mathbf{23}_1 \ldots \mathbf{23}_M$ formed during casting of the concrete block $\mathbf{12}_j$. This pattern of cast relief elements $\mathbf{23}_1 \ldots \mathbf{23}_M$ includes a plurality of peaks and a plurality of valleys, which are sized so as to be visually distinguishable when the concrete block $\mathbf{12}_j$ is placed in the paved surface 10. It is to be understood that various other patterns of cast relief elements are possible.

The cast texture of the natural-stone-like surface portion $\mathbf{20}_k$ defines a "surface level difference" ΔL, which refers to the normal distance between a maximum level $L_{max}$ and a minimum level of that surface portion. As shown in FIG. 4, the concrete block $\mathbf{12}_j$ can be viewed as defining orthogonal X, Y and Z axes, where the X-Y plane is parallel to a plane that would be formed by the natural-stone-like surface portion $\mathbf{20}_k$ if that surface portion was flat (i.e., the plane in which lies the boundary 22 of the natural-stone-like surface portion $\mathbf{20}_k$). A level L at a given point of the natural-stone-like surface portion $\mathbf{20}_k$ can be viewed as a plane parallel to the X-Y plane, and the surface level difference ΔL can be viewed as being measured along the Z axis.

In this example, the minimum level $L_{min}$ of the natural-stone-like surface portion $\mathbf{20}_k$ is located at its boundary 22. Generally, the minimum level $L_{min}$ of a natural-stone-like surface portion may be located anywhere on that surface portion, including at a location away from its boundary 22. The maximum level $L_{max}$ of a natural-stone-like surface portion may also be located anywhere on that surface portion, including at its boundary 22.

With the concrete block $\mathbf{12}_j$ being used in a paving application, in some embodiments, the surface level difference ΔL may be greater than 4 mm, for example, between 4 mm and 12 mm. For instance, in one embodiment, the surface level difference ΔL may be about 8 mm. This enables the natural-stone-like surface portion $\mathbf{20}_k$ to exhibit desired natural stone appearance characteristics, while maintaining a degree of surface irregularity suitable for supporting pedestrian or other traffic. In other embodiments, the surface level difference ΔL may be greater, for example, between 10 mm and 30 min. For instance, in one embodiment, the surface level difference ΔL may be about 20 mm.

It is to be noted that the natural-stone-like surface portions $\mathbf{20}_1$ and $\mathbf{20}_2$ of the concrete block $\mathbf{12}_j$ may define a common surface level difference ΔL or distinct surface level differences ΔL, a common maximum level $L_{max}$ or distinct maximum levels $L_{max}$, and/or a common minimum level $L_{min}$ or distinct minimum levels $L_{min}$.

Each of the cast relief elements $\mathbf{23}_1 \ldots \mathbf{23}_M$ of the natural-stone-like surface portion $\mathbf{20}_k$ reaches a respective level L that is either the maximum level $L_{max}$, the minimum level $L_{min}$, or a level therebetween. In this embodiment, plural ones of the cast relief elements $\mathbf{23}_1 \ldots \mathbf{23}_M$ are seen as extending to the maximum level $L_{max}$ of the natural-stone-like surface portion $\mathbf{20}_k$ and separated from each other by other ones of the cast relief elements $\mathbf{23}_1 \ldots \mathbf{23}_M$ that only extend to lower levels.

Also, each of the cast relief elements $\mathbf{23}_1 \ldots \mathbf{23}_M$ of the natural-stone-like surface portion $\mathbf{20}_k$ that is a valley (e.g., the cast relief element $\mathbf{23}_2$) can be viewed as having a respective depth D, which refers to the normal distance between the maximum level $L_{max}$ of that surface portion and that valley's deepest point. Depending on the surface level difference ΔL, in some cases, the depth D of each of one or more valleys of the natural-stone-like surface portion $\mathbf{20}_k$ may be greater than 4 mm, for example, between 4 mm and 10 mm. This may further enhance natural stone appearance characteristics exhibited by the natural-stone-like surface portion $\mathbf{20}_k$.

The natural-stone-like surface portion $\mathbf{20}_k$ interacts with ambient light to create shadows that further contribute to its natural stone appearance. More particularly, each point of the cast texture of the natural-stone-like surface portion $\mathbf{20}_k$ defines a respective "texture angle" θ, which refers to the angle between a plane parallel to the X-Y plane and a plane tangent to the natural-stone-like surface portion $\mathbf{20}_k$ at that point. In some embodiments, the texture angle θ of each of a plurality of points of the natural-stone-like surface portion $\mathbf{20}_k$ may be between 75° and 90°. This may contribute to creation of shadows on the natural-stone-like surface portion $\mathbf{20}_k$ that further enhance its natural stone appearance. Configuring a dry-cast concrete block with a surface level difference ΔL in the above-mentioned ranges has been found to facilitate formation of such texture angles θ during casting. It is noted, however, that the above-mentioned values of texture angle θ are presented for example purposes only and are not to be considered limiting in any respect.

The depression 30 of the front surface 14 that separates the natural-stone-like surface portions $\mathbf{20}_1$,$\mathbf{20}_2$ can be viewed as having a depth, which refers to the normal distance between the maximum level $L_{max}$ of either of these surface portions and that depression's deepest point. Depending on the surface level difference ΔL, the depth of the depression 30 may take on various values. For example, in some embodiment, the depth of the depressions 30 may be at least 10 mm, for instance, between 10 mm and 30 mm. This may further enhance natural stone appearance characteristics exhibited by the natural-stone-like surface portions $\mathbf{20}_1$, $\mathbf{20}_2$ of the concrete block $\mathbf{12}_j$.

It will thus be appreciated that, when placed in an interlocking pattern in the paved surface 10, the concrete blocks $\mathbf{12}_1 \ldots \mathbf{12}_N$, with their irregular shapes defined by their side surfaces $\mathbf{18}_1 \ldots \mathbf{18}_5$ and with their natural-stone-like surface portions, provide a natural and aesthetic look to the paved surface 10, which appears to be made of several highly randomly shaped natural stones.

In addition, with their side surfaces $\mathbf{18}_1 \ldots \mathbf{18}_5$ configured as described above, the concrete blocks $\mathbf{12}_1 \ldots \mathbf{12}_N$ can be efficiently and conveniently installed in courses in a running bond or other linear bond. Furthermore, owing to their side surfaces $\mathbf{18}_1 \ldots \mathbf{18}_5$, adjacent ones of the concrete blocks $\mathbf{12}_1 \ldots \mathbf{12}_N$ may be rotated by 180° when installed in the paved surface 10, thereby providing additional flexibility in creating highly random-looking patterns.

Also, as they may be made of no-slump concrete and have their natural stone appearance realized during casting without requiring any subsequent mechanical artificial aging/weathering process (e.g., tumbling, object impacting, etc.), concrete blocks such as the concrete blocks $\mathbf{12}_1 \ldots \mathbf{12}_N$ may be mass-produced with high efficiency. An example of implementation of a process for manufacturing concrete blocks such as the concrete blocks $\mathbf{12}_1 \ldots \mathbf{12}_N$ will be presented later on.

Figure 5A:
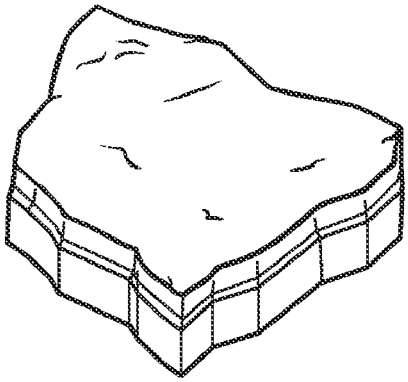
FIGS. 5A to 5C show examples of concrete blocks having another irregular shape, in accordance with various embodiments of the invention.
Figure 5B:
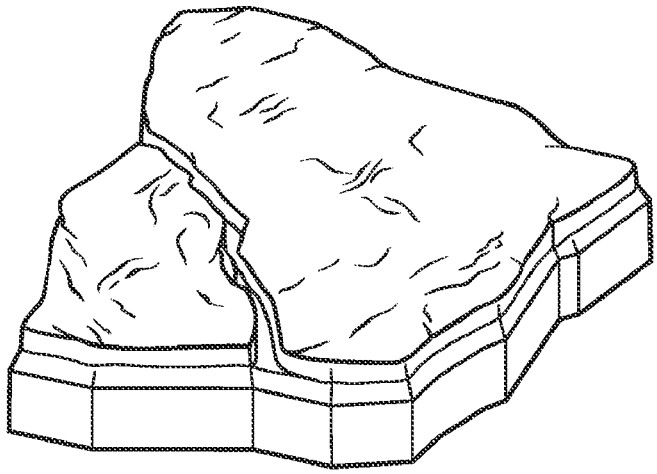
Figure 5C:
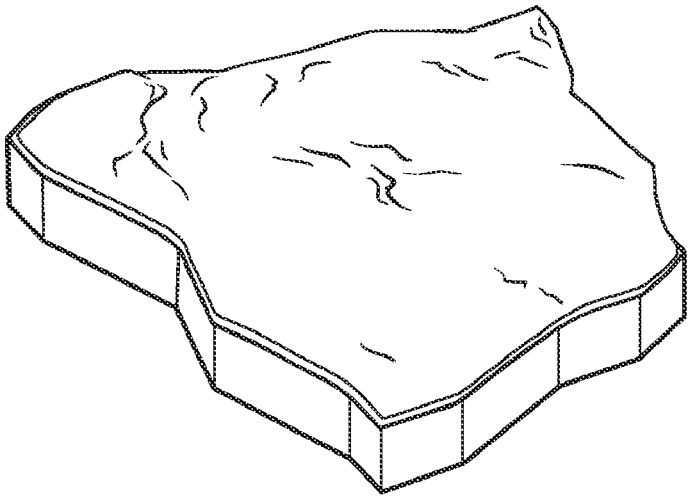

While in this embodiment the concrete blocks $\mathbf{12}_1 \ldots \mathbf{12}_N$ have a particular irregular shape defined by their side surfaces $\mathbf{18}_1 \ldots \mathbf{18}_5$, it will be appreciated that the concrete blocks $\mathbf{12}_1 \ldots \mathbf{12}_N$ may have various other irregular shapes in other embodiments. In particular, by configuring their side surfaces $\mathbf{18}_1 \ldots \mathbf{18}_5$ according to the aforementioned set of rules, the concrete blocks $\mathbf{12}_1 \ldots \mathbf{12}_N$ may have a virtually infinite number of irregular, highly random-looking shapes. For instance, FIGS. 5A to 5C show examples of other concrete blocks having another irregular shape configured according to the aforementioned set of rules. More specifically: FIG. 5A shows an example of a paver with an entirety of its front surface having a texture with a natural stone appearance; FIG. 5B shows a paver whose front surface has a false joint separating two (2) portions representing two (2) natural stones; and FIG. 5C shows a paving slab. It is also reiterated that, while in embodiments considered above the front surface 14 of each of the concrete blocks $\mathbf{12}_1 \ldots \mathbf{12}_N$ has one or more natural-stone-like surface portions, in some embodiments, the front surface 14 may not comprise any natural-stone-like surface portion. In particular, the front surface 14 of each of the concrete blocks $\mathbf{12}_1 \ldots \mathbf{12}_N$ may have any desired configuration.

The aforementioned set of rules according to which the side surfaces $\mathbf{18}_1 \ldots \mathbf{18}_5$ of each of the concrete block $\mathbf{12}_1 \ldots \mathbf{12}_N$ are configured may also be used to provide larger, irregularly, random-looking shaped concrete blocks that can be placed into an interlocking pattern.

Figure 6A:
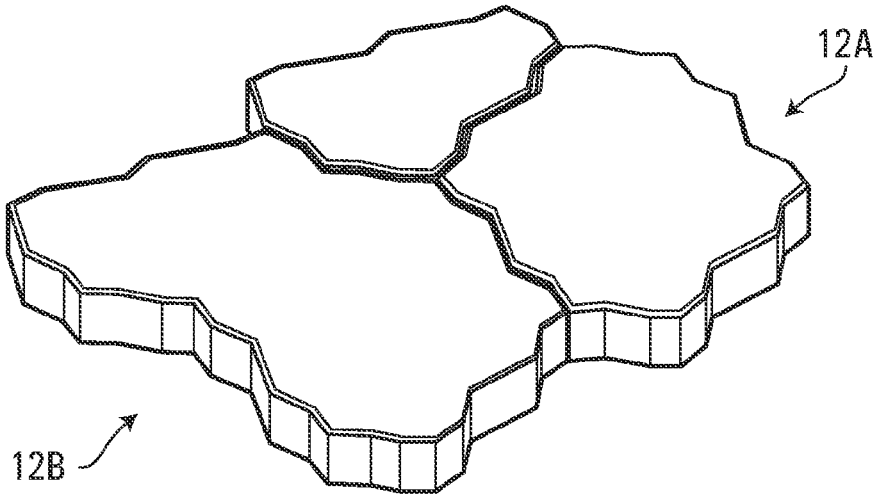
FIGS. 6A to 6C show examples of concrete blocks in accordance with another embodiment of the invention.
Figure 6B:
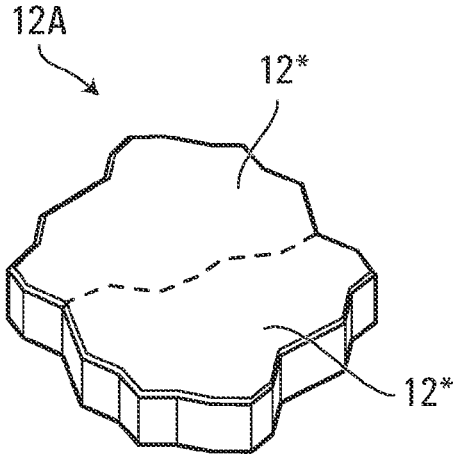
Figure 6C:
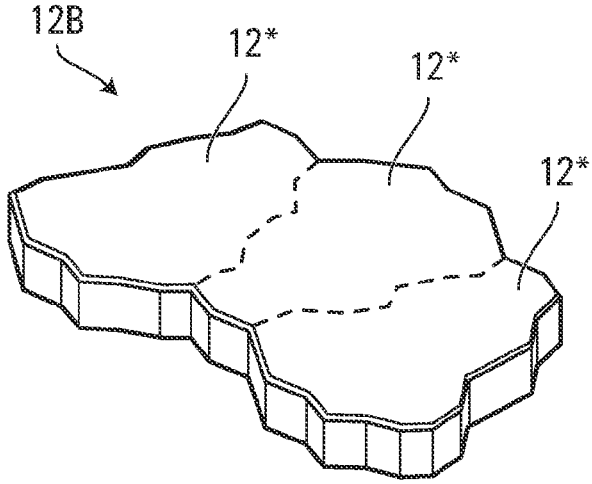

For example, FIGS. 6A to 6C show concrete blocks 12A and 12B placed in an interlocking pattern with a concrete block such as the concrete blocks $\mathbf{12}_1 \ldots \mathbf{12}_N$, thereby producing a paved area with a further enhanced natural and random look. Each of the concrete blocks 12A and 12B is conceptually formed of a number of contiguous instances of a basic shape 12* which comprises side surfaces that correspond to the side surfaces $\mathbf{18}_1 \ldots \mathbf{18}_5$ of the concrete block $\mathbf{12}_j$. In this case, these contiguous instances of the basic shape 12* are contiguous along the side surfaces that correspond to the fifth side surface $\mathbf{18}_5$ of the concrete block $\mathbf{12}_j$. More-particularly, the concrete block 12A is conceptually formed of two (2) instances of the basic shape 12* that are contiguous, while the concrete block 12B is conceptually formed of three (3) instances of the basic shape 12* that are contiguous.

Figure 7:
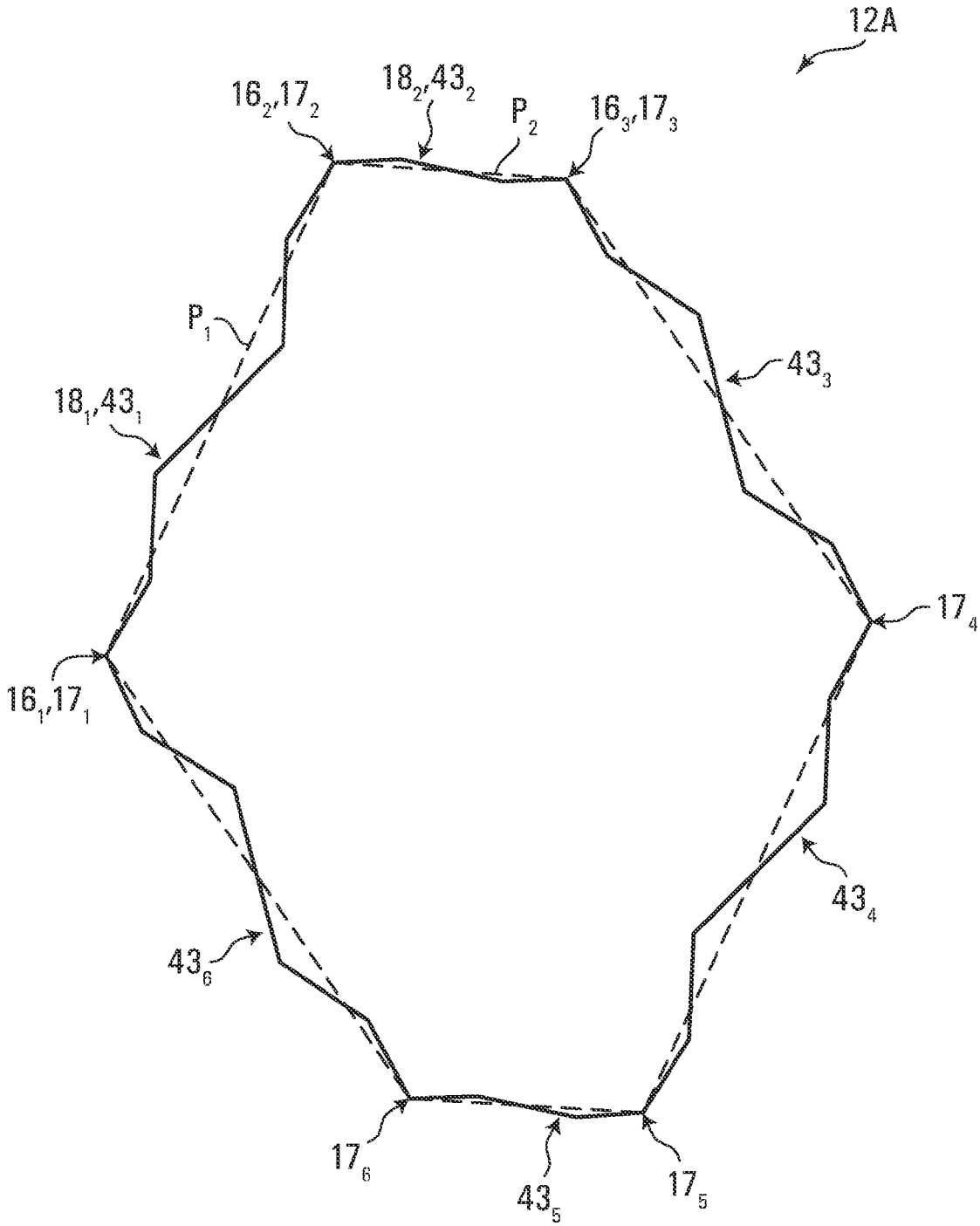
FIG. 7 shows an outline of side surfaces of the concrete block shown in FIG. 6B.

FIG. 7 illustrates another way of visualizing how the concrete block 12A, which is formed of two (2) contiguous instances of the basic shape 12*, is configured. Specifically, the concrete block 12A comprises six (6) side surfaces $\mathbf{43}_1 \ldots \mathbf{43}_6$ that extend between six (6) edges $\mathbf{17}_1 \ldots \mathbf{17}_6$. In this example, the side surfaces $\mathbf{43}_1$, $\mathbf{43}_2$ of the concrete block 12A respectively correspond to the side surfaces $\mathbf{18}_1$, $\mathbf{18}_2$ of the concrete block $\mathbf{12}_j$. Each of the side surfaces $\mathbf{43}_3$, $\mathbf{43}_4$, $\mathbf{43}_6$ is congruent with the side surface $\mathbf{43}_1$, while the side surface $\mathbf{43}_5$ is congruent with the side surface $\mathbf{43}_2$. In other words, opposite ones of the side surfaces $\mathbf{43}_1 \ldots \mathbf{43}_6$ are congruent and each of these side surfaces has one of two different shapes, i.e., each of the side surfaces $\mathbf{43}_1$, $\mathbf{43}_3$, $\mathbf{43}_4$, $\mathbf{43}_6$ has a first shape and each of the side surfaces $\mathbf{43}_2$, $\mathbf{43}_5$ has a second shape different from the first shape.

It will be appreciated that, in other embodiments, a concrete block may be conceptually formed of any other number of contiguous instances of a basic shape configured according to the aforementioned set of rules. Also, although not shown, concrete blocks such as the concrete blocks 12A and 12B may have a front surface with one or more natural-stone-like surface portions similar to the natural-stone-like surface portions $\mathbf{20}_1$, $\mathbf{20}_2$ of the front surface 14 of the concrete block $\mathbf{12}_j$.

Figure 8:
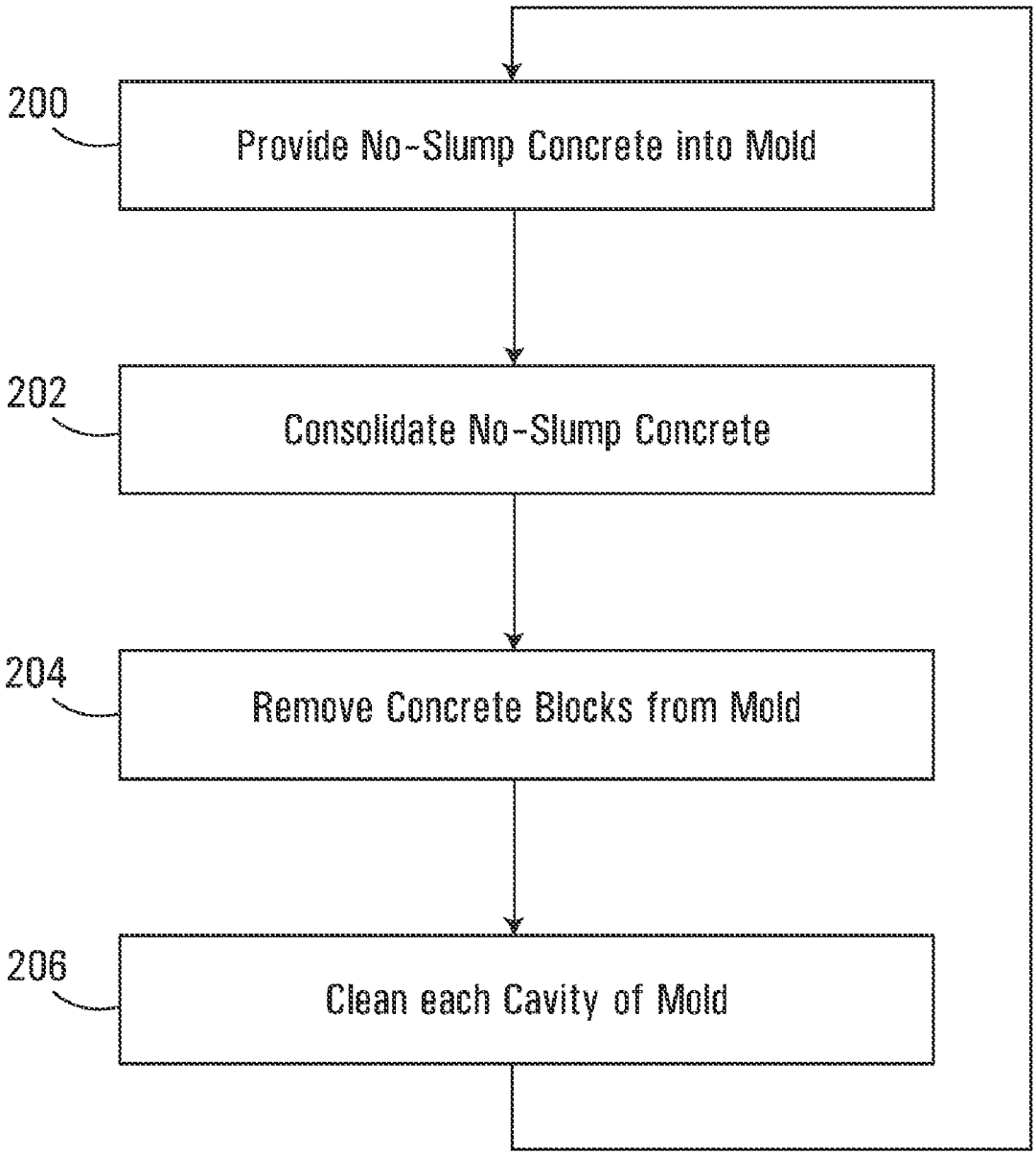
FIG. 8 is a flowchart illustrating an example of a process for manufacturing concrete blocks in accordance with an embodiment of the invention.

Turning now to FIG. 8, there is shown a flowchart illustrating an example of a process for manufacturing concrete blocks such as the concrete blocks $\mathbf{12}_1 \ldots \mathbf{12}_N$, 12A and 12B.

At step 200, no-slump concrete is placed into a mold. To facilitate mass-production, in one embodiment, the mold has a plurality of cavities. In other embodiments, a plurality of molds each with a single cavity or each with a respective plurality of cavities may be used. To further facilitate mass-production, the mold may be located such that concrete blocks are placed on a production board when removed therefrom.

Each cavity of the mold is configured to form a respective concrete block comprising side surfaces configured according to the aforementioned set of rules (such as the side surfaces $\mathbf{18}_1 \ldots \mathbf{18}_5$ of the concrete block $\mathbf{12}_j$), and, optionally, a front surface with one or more natural-stone-like surface portions (such as the front surface 14 of the concrete block $\mathbf{12}_j$ with its two (2) natural-stone-like surface portions $\mathbf{20}_1$ and $\mathbf{20}_2$). To that end, each cavity is associated with a surface of the mold that includes at least one portion with a surface texture corresponding to the desired natural stone appearance (hereinafter referred to as "the at least one natural-stone-like surface portion of the mold"). In embodiments directed to producing concrete blocks with a plurality of natural-stone-like surface portions (such as some of those shown in FIG. 1), each cavity of the mold that is intended to form such concrete blocks may be associated with a corresponding plurality of natural-stone-like surface portions. Each of the at least one natural-stone-like surface portion of the mold thus defines a surface level difference $\Delta L'$ that corresponds to the desired surface level difference $\Delta L$ (FIG. 4) of the corresponding natural-stone-like surface portion of the concrete block to be formed. Each point of this surface portion also defines a respective texture angle $\theta'$ corresponding to the desired texture angle $\theta$ (FIG. 4) of each point of the corresponding natural-stone-like surface portion of the concrete block to be formed.

In order to closely simulate natural stone, in some embodiments, each given natural-stone-like surface portion of the mold, and thus the corresponding natural-stone-like surface portion of concrete blocks to be formed by the mold, may be based on a natural stone's surface. For example, data representative of at least a portion of the natural stone's surface may be obtained, for instance, via three-dimensional scanning of the natural stone's surface. The obtained data may then be computer processed using software in order to generate data representative of the given natural-stone-like surface portion of the mold. In some cases, this processing may include modifying the obtained data representative of at least a portion of the natural stone's surface to set the desired surface level difference $\Delta L'$ and texture angles $\theta'$ of the given natural-stone-like surface portion.

As another possible consideration, in embodiments where individual ones of the cavities of the mold are intended to form concrete blocks of similar overall dimensions but with natural-stone-like surface portions that have different configurations (e.g., different patterns of cast relief elements), these individual cavities may be designed to each have a common volume in order to facilitate production. In other words, a first cavity intended to form concrete blocks with natural-stone-like surface portions having a first configuration may have a first volume, and a second cavity intended to form concrete blocks with natural-stone-like surface portions having a second configuration different from the first configuration may have a second volume substantially corresponding to the first volume. This facilitates provision of substantially the same quantity of concrete into each cavity of the mold, which in turn facilitates efficient casting of concrete blocks in the mold and subsequent removal of the concrete blocks therefrom. In embodiments where individual ones of the cavities of the mold are intended to form concrete blocks of significantly different overall dimensions and with natural-stone-like surface portions that have different configurations (e.g., different patterns of cast relief elements), similar production benefits may be achieved by designing these individual cavities to each have a common volume per unit area.

The mold may be manufactured via computer-aided manufacturing based on the data representative of each given natural-stone-like surface portion of the mold. Since no-slump concrete can be used, the mold may be made of metal or other rigid material. There is no requirement for one or more portions of the mold to be made of elastomeric material (e.g., rubber), which is typically used in molds for casting wet-cast concrete blocks with a natural stone appearance.

Thus, during step 200, each cavity of the mold is filled with no-slump concrete in order to form a concrete block comprising side surfaces configured according to the aforementioned set of rules, and, optionally, a front surface with one or more natural-stone-like surface portions.

At step 202, the no-slump concrete in the mold is consolidated. Consolidation may include inducing vibration of the no-slump concrete in the mold so as to cause it to compact itself and closely conform to each cavity of the mold. A pre-vibration phase may be effected during step 200 to facilitate filling of the no-slump concrete in the mold and its eventual consolidation. Consolidation may also include application of pressure on the concrete in combination with its vibration. It will be appreciated that consolidation may be effected using various other techniques.

Upon completion of step 202, the no-slump concrete in each cavity of the mold has formed into a concrete block comprising side surfaces configured according to the aforementioned set of rules, and, optionally, a front surface with one or more natural-stone-like surface portions.

At step 204, the concrete block in each cavity of the mold is removed therefrom and continues on the production board. The concrete blocks may be directly stored for curing purposes. Since provision of a natural stone appearance may be effected during casting, the concrete blocks do not require a subsequent mechanical artificial aging/weathering process (e.g., tumbling, object impacting, etc.) to impart them with such an appearance. Since the concrete blocks can be made of no-slump concrete, curing times are relatively short such that they can be available for use within a short period of time (e.g., one day). At step 206, each cavity of the mold is cleaned such that casting of new concrete blocks may be effected. In one embodiment, a cleaning unit uses a fluid to clean each cavity of the mold. The fluid may be a gas (e.g., compressed air) or a liquid whose flow relative to each cavity of the mold, and particularly each natural-stone-like area of the mold, removes therefrom substantially any remaining no-slump concrete. Such a fluid-based cleaning action advantageously enables rapid cleaning of each cavity of the mold, thereby increasing production efficiency. In some cases, the cleaning unit may also use, in addition to the fluid, one or more brushes to clean each cavity of the mold, whereby the fluid-based cleaning action is combined with a brushing cleaning action. It will be appreciated that other embodiments may employ various other types of cleaning action.

In this example, the process returns to step 200 where a new production cycle begins. In some embodiments, utilization of no-slump concrete in combination with rapid cleaning of the mold and other elements of the process may enable a production cycle to take a relatively short period of time (e.g., 15 to 20 seconds per square meter of finished products in some cases).

While this example illustrates one possible process that can be used to produce concrete blocks such as the concrete blocks $\mathbf{12}_1 \ldots \mathbf{12}_N$, 12A and 12B, it will be appreciated that various other processes may be used to manufacture such blocks.

Although in embodiments considered above the concrete blocks $\mathbf{12}_1 \ldots \mathbf{12}_N$ are used in an arrangement whereby they are interlocked to form part of the paved surface 10, in other embodiments, concrete blocks configured according to principles discussed herein may, even though they are capable of interlocking with one another, be placed in an arrangement whereby there is some space between side surfaces of adjacent blocks (e.g., to let grass grow in between them).

Also, while in embodiments considered above the concrete blocks $\mathbf{12}_1 \ldots \mathbf{12}_N$ are used in an arrangement, in other embodiments, a concrete block configured according to principles discussed herein may, even though it is suitable for use in an arrangement of blocks, be used individually (e.g., as a stepping stone) without being arranged with other similar concrete blocks.

In addition, although in embodiments considered above the concrete blocks $\mathbf{12}_1 \ldots \mathbf{12}_N$ are paving units used in the paved surface 10, in other embodiments, concrete blocks configured according to principles discussed herein may be used in various other types of structures. For example, in some embodiments, concrete blocks configured according to principles discussed herein may be wall units for use in walls (e.g., building walls, retaining walls and other landscaping walls, acoustic walls, etc.), steps unit for use in steps, or blocks for use in other types of structures.

Furthermore, while embodiments considered above relate to concrete blocks, in other embodiments, and depending on their application, blocks configured according to principles discussed herein may be made of various other materials (e.g., polymers, metals, etc.).

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A block suitable for use in an arrangement of blocks that are interlocked, said block comprising:

a first side surface extending between a first edge and a second edge, said first side surface being irregular and having a first half and a second half that are congruent such that, when viewing the first side surface as a two-dimensional locus of points, the second half of the first side surface corresponds to a 180°-rotated version of the first half of the first side surface;

a second side surface extending between said second edge and a third edge, said second side surface having a first half and a second half that are congruent such that, when viewing the second side surface as a two-dimensional locus of points, the second half of the second side surface corresponds to a 180°-rotated version of the first half of the second side surface;

a third side surface extending between said first edge and a fourth edge, said third side surface being congruent with a first portion of said first side surface;

a fourth side surface extending between said third edge and a fifth edge, said fourth side surface being congruent with a second portion of said first side surface such that said first portion and said second portion of said first side surface constitute said first side surface; and a fifth side surface extending between said fourth edge and said fifth edge, said fifth side surface having a first half and a second half that are congruent such that, when viewing the fifth side surface as a two-dimensional locus of points, the second half of the fifth side surface corresponds to a 180°-rotated version of the first half of the fifth side surface.

2. A block as claimed in claim 1, wherein said second side surface is irregular.

3. A block as claimed in claim 1, wherein said fifth side surface is irregular.

4. A block as claimed in claim 1, wherein said first portion of said first side surface has at least one irregularity and said third side surface has at least one irregularity congruent with said at least one irregularity of said first portion of said first side surface.

5. A block as claimed in claim 4, wherein said second portion of said first side surface has at least one irregularity and said fourth side surface has at least one irregularity congruent with said at least one irregularity of said second portion of said first side surface.

6. A block as claimed in claim 1, comprising a front surface to be exposed when said block is in the arrangement of blocks, said front surface comprising at least one portion having a texture with a natural stone appearance.

7. A block as claimed in claim 6, wherein said at least one portion of said front surface comprises a plurality of portions each having a texture with a natural stone appearance, said plurality of portions of said front surface representing a plurality of natural stones.

8. A block as claimed in claim 6, wherein said at least one portion of said front surface is an entirety of said front surface.

9. A block as claimed in claim 1, wherein said first side surface, said second side surface, said third side surface, said fourth side surface and said fifth side surface are shaped differently from one another.

10. A block as claimed in claim 1, wherein said first side surface, said second side surface, said third side surface, said fourth side surface and said fifth side surface are configured such that said block is installable in a course with adjacent blocks in the arrangement of blocks.

11. A block as claimed in claim 1, wherein the arrangement of blocks is part of a paved surface and said block is a paving unit.

12. A block as claimed in claim 1, wherein the arrangement of blocks is part of a wall and said block is a wall constructing unit.

13. A block suitable for use in an arrangement of blocks that are interlocked, said block comprising a plurality of side surfaces configured such that said block has a shape formed of a plurality of contiguous instances of a basic shape, said basic shape comprising:

a first side surface extending between a first edge and a second edge, said first side surface being irregular and having a first half and a second half that are congruent such that, when viewing the first side surface as a two-dimensional locus of points, the second half of the first side surface corresponds to a 180°-rotated version of the first half of the first side surface;

a second side surface extending between said second edge and a third edge, said second side surface having a first half and a second half that are congruent such that, when viewing the second side surface as a two-dimensional locus of points, the second half of the second side surface corresponds to a 180°-rotated version of the first half of the second side surface;

a third side surface extending between said first edge and a fourth edge, said third side surface being congruent with a first portion of said first side surface;

a fourth side surface extending between said third edge and a fifth edge, said fourth side surface being congruent with a second portion of said first side surface such that said first portion and said second portion of said first side surface constitute said first side surface; and a fifth side surface extending between said fourth edge and said fifth edge, said fifth side surface having a first half and a second half that are congruent such that, when viewing the fifth side surface as a two-dimensional locus of points, the second half of the fifth side surface corresponds to a 180°-rotated version of the first half of the fifth side surface.

14. A block as claimed in claim 13, wherein said second side surface is irregular.

15. A block as claimed in claim 13, wherein said fifth side surface is irregular.

16. A block as claimed in claim 13, wherein said first portion of said first side surface has at least one irregularity and said third side surface has at least one irregularity congruent with said at least one irregularity of said first portion of said first side surface.

17. A block as claimed in claim 16, wherein said second portion of said first side surface has at least one irregularity and said fourth side surface has at least one irregularity congruent with said at least one irregularity of said second portion of said first side surface.

18. A block as claimed in claim 13, comprising a front surface to be exposed when said block is in the arrangement of blocks, said front surface comprising at least one portion having a texture with a natural stone appearance.

19. A block as claimed in claim 18, wherein said at least one portion of said front surface comprises a plurality of portions each having a texture with a natural stone appearance, said plurality of portions of said front surface representing a plurality of natural stones.

20. A block as claimed in claim 18, wherein said at least one portion of said front surface is an entirety of said front surface.

21. A block as claimed in claim 13, wherein any two of the plurality of contiguous instances of said basic shape are contiguous along said fifth side surface of said basic shape.

22. A block as claimed in claim 13, wherein said first side surface, said second side surface, said third side surface, said fourth side surface and said fifth side surface are shaped differently from one another.

23. A block as claimed in claim 13, wherein said first side surface, said second side surface, said third side surface, said fourth side surface and said fifth side surface are configured such that said block is installable in a course with adjacent blocks in the arrangement of blocks.

24. A block as claimed in claim 13, wherein the arrangement of blocks is part of a paved surface and said block is a paving unit.

25. A block as claimed in claim 13, wherein the arrangement of blocks is part of a wall and said block is a wall constructing unit.

26. A set of blocks capable of interlocking with one another, each block comprising a plurality of side surfaces configured such that said block has a shape formed of at least one instance of a basic shape, said basic shape comprising:

a first side surface extending between a first edge and a second edge, said first side surface being irregular and having a first half and a second half that are congruent such that, when viewing the first side surface as a two-dimensional locus of points, the second half of the first side surface corresponds to a 180°-rotated version of the first half of the first side surface;

a second side surface extending between said second edge and a third edge, said second side surface having a first half and a second half that are congruent such that, when viewing the second side surface as a two-dimensional locus of points, the second half of the second side surface corresponds to a 180°-rotated version of the first half of the second side surface;

a third side surface extending between said first edge and a fourth edge, said third side surface being congruent with a first portion of said first side surface;

a fourth side surface extending between said third edge and a fifth edge, said fourth side surface being congruent with a second portion of said first side surface such that said first portion and said second portion of said first side surface constitute said first side surface; and a fifth side surface extending between said fourth edge and said fifth edge, said fifth side surface having a first half and a second half that are congruent such that, when viewing the fifth side surface as a two-dimensional locus of points, the second half of the fifth side surface corresponds to a 180°-rotated version of the first half of the fifth side surface;

said set of blocks comprising:

a first block having a shape formed of a single instance of said basic shape; and a second block having a shape formed of a plurality of contiguous instances of said basic shape.

27. A set of blocks as claimed in claim 26, wherein adjacent ones of said blocks are installable in a course.

28. A set of blocks as claimed in claim 26, wherein said blocks are paving units.

29. A block suitable for use in an arrangement of blocks that are interlocked, said block comprising:

a first side surface extending between a first edge and a second edge, said first side surface being irregular and having a first half and a second half that are congruent such that, when viewing the first side surface as a two-dimensional locus of points, the second half of the first side surface corresponds to a 180°-rotated version of the first half of the first side surface;

a second side surface extending between said second edge and a third edge, said second side surface having a first half and a second half that are congruent such that, when viewing the second side surface as a two-dimensional locus of points, the second half of the second side surface corresponds to a 180°-rotated version of the first half of the second side surface;

a third side surface extending between said third edge and a fourth edge, said third side surface being congruent with said first side surface;

a fourth side surface extending between said fourth edge and a fifth edge, said fourth side surface being congruent with said first side surface;

a fifth side surface extending between said fifth edge and a sixth edge, said fifth side surface being congruent with said second side surface; and a sixth side surface extending between said first edge and said sixth edge, said sixth side surface being congruent with said first side surface.

30. A block suitable for use in an arrangement of blocks that are interlocked, said block comprising:

a first side surface extending between a first edge and a second edge, said first side surface being irregular and having a first half and a second half that are congruent such that, when viewing the first side surface as a two-dimensional locus of points, the second half of the first side surface corresponds to a 180°-rotated version of the first half of the first side surface, said first side surface having a profile length;

a second side surface extending between said second edge and a third edge, said second side surface having a first half and a second half that are congruent such that, when viewing the second side surface as a two-dimensional locus of points, the second half of the second side surface corresponds to a 180°-rotated version of the first half of the second side surface;

a third side surface extending between said first edge and a fourth edge, said third side surface being congruent with a first portion of said first side surface, said third side surface having a profile length;

a fourth side surface extending between said third edge and a fifth edge, said fourth side surface being congruent with a second portion of said first side surface, said fourth side surface having a profile length, the profile length of the first side surface corresponding to the profile length of the third side surface added to the profile length of the fourth side surface; and a fifth side surface extending between said fourth edge and said fifth edge, said fifth side surface having a first half and a second half that are congruent such that, when viewing the fifth side surface as a two-dimensional locus of points, the second half of the fifth side surface corresponds to a 180°-rotated version of the first half of the fifth side surface.

* * * * *